US006059114A

United States Patent [19]

Loftus

[11] Patent Number: 6,059,114

[45] Date of Patent: May 9, 2000

[54] CONTAINER

[75] Inventor: Stephen Clive Loftus, Bloxwich, United Kingdom

[73] Assignee: McKechnie UK Limited, West Midlands, United Kingdom

[21] Appl. No.: 09/214,208

[22] PCT Filed: Jul. 3, 1997

[86] PCT No.: PCT/GB97/01796

§ 371 Date: Apr. 26, 1999

§ 102(e) Date: Apr. 26, 1999

[87] PCT Pub. No.: WO98/01353

PCT Pub. Date: Jan. 15, 1998

[30] Foreign Application Priority Data

Jul. 3, 1996 [GB] United Kingdom ..... 9613949
Aug. 16, 1996 [GB] United Kingdom ..... 9617218

[51] Int. Cl.[7] ..... B65D 21/06

[52] U.S. Cl. ..... 206/506; 220/756

[58] Field of Search ..... 206/506, 503, 206/501; 220/756

[56] References Cited

U.S. PATENT DOCUMENTS

| | | | |
|---|---|---|---|
| 3,214,056 | 10/1965 | Box . | |
| 4,105,117 | 8/1978 | Atkin et al. . | |
| 4,391,369 | 7/1983 | Stahl et al. | 206/506 |
| 4,573,577 | 3/1986 | Miller | 206/506 |
| 4,848,578 | 7/1989 | Schafer | 206/506 |
| 4,947,992 | 8/1990 | Schafer | 206/506 |
| 5,469,986 | 11/1995 | Jang . | |
| 5,609,254 | 3/1997 | Loftus et al. | 206/506 |

FOREIGN PATENT DOCUMENTS

| | | |
|---|---|---|
| 0 334 348 A2 | 9/1989 | European Pat. Off. . |
| 0 337 840 | 10/1989 | European Pat. Off. . |
| 0 770 557 A1 | 5/1997 | European Pat. Off. . |
| 75 23 432 U | 3/1976 | Germany . |
| 295 09 579 U1 | 12/1995 | Germany . |
| 945 102 | 12/1963 | United Kingdom . |
| 1 574 117 | 9/1980 | United Kingdom . |
| 2 129 401 | 5/1984 | United Kingdom . |
| 2 171 980 | 9/1986 | United Kingdom . |
| 2 274 643 | 8/1994 | United Kingdom . |

*Primary Examiner*—Joseph M. Moy
*Attorney, Agent, or Firm*—Adams Law Firm, P.A.

[57] ABSTRACT

An open-topped container (10) has stacking bars (12) which have a series of equally spaced ribs (18) projecting upwardly to engage with ribs (22) formed in the base of a container stacked above.

14 Claims, 4 Drawing Sheets

CONTAINER

This application is a national stage application, according to Chapter II of the Patent Cooperation Treaty. This application claims the priority date of Jul. 3, 1996 for Great Britain Patent Application No. 9613949.8.

The present invention relates to stacking containers and particularly, but not exclusively, to containers which can selectively nest or stack.

Nesting and stacking containers are used for a variety of applications, including delivery of goods to retail premises. For this, they are often stacked, for instance on a pallet. If the containers are not securely stacked, damage to their contents can result, and handling the stack can be dangerous for workmen.

The present invention seeks to provide an improved stacking container.

The invention provides an open-topped container comprising at least one stacking member which has a first position extending across the container for supporting a second container to form a stack, the stacking member being so formed as to engage a container stacked thereon to prevent lateral movement of the upper container, and wherein the stacking member is formed to provide the said engagement over a range of positions along the stacking member, whereby upper containers of a plurality of different sizes may be held at any of a plurality of positions relative to the container.

The stacking member preferably comprises a plurality of formations for engaging a container above, and at least some of which may resist relative movement in a first sense, but allow relative movement in the opposite sense. Others may resist relative movement in the second sense, but allow relative movement in the first sense. The stacking member may comprise a plurality of recesses and/or projections for engaging a container above. The stacking member may comprise a plurality of ribs which define recesses therebetween, at least some of the ribs being regularly spaced and preferably having a saw-tooth profile.

The base of the container preferably has formations which enhance engagement with the stacking member of a like container below. The base formations may comprise a plurality of formations complementary to the formations on the stacking member and the formations may be regularly spaced to allow the stacking members to engage a base at a plurality of relative positions.

The stacking member is preferably a bar and may be movable to a second position at which the container mouth is sufficiently clear to allow a like container to be nested therein.

The invention also provides a system comprising a plurality of containers as aforesaid, the containers having a plurality of different sizes and each having engaging formations compatible with smaller-sized containers, wherein each container can be stacked with engagement at any of a plurality of positions on a large container below.

The containers of the system may have any feature or combination of features of the containers set out above.

One embodiment of the present invention will now be described in more detail, by way of example only, and with reference to the accompanying drawings, in which.

Figure 1:
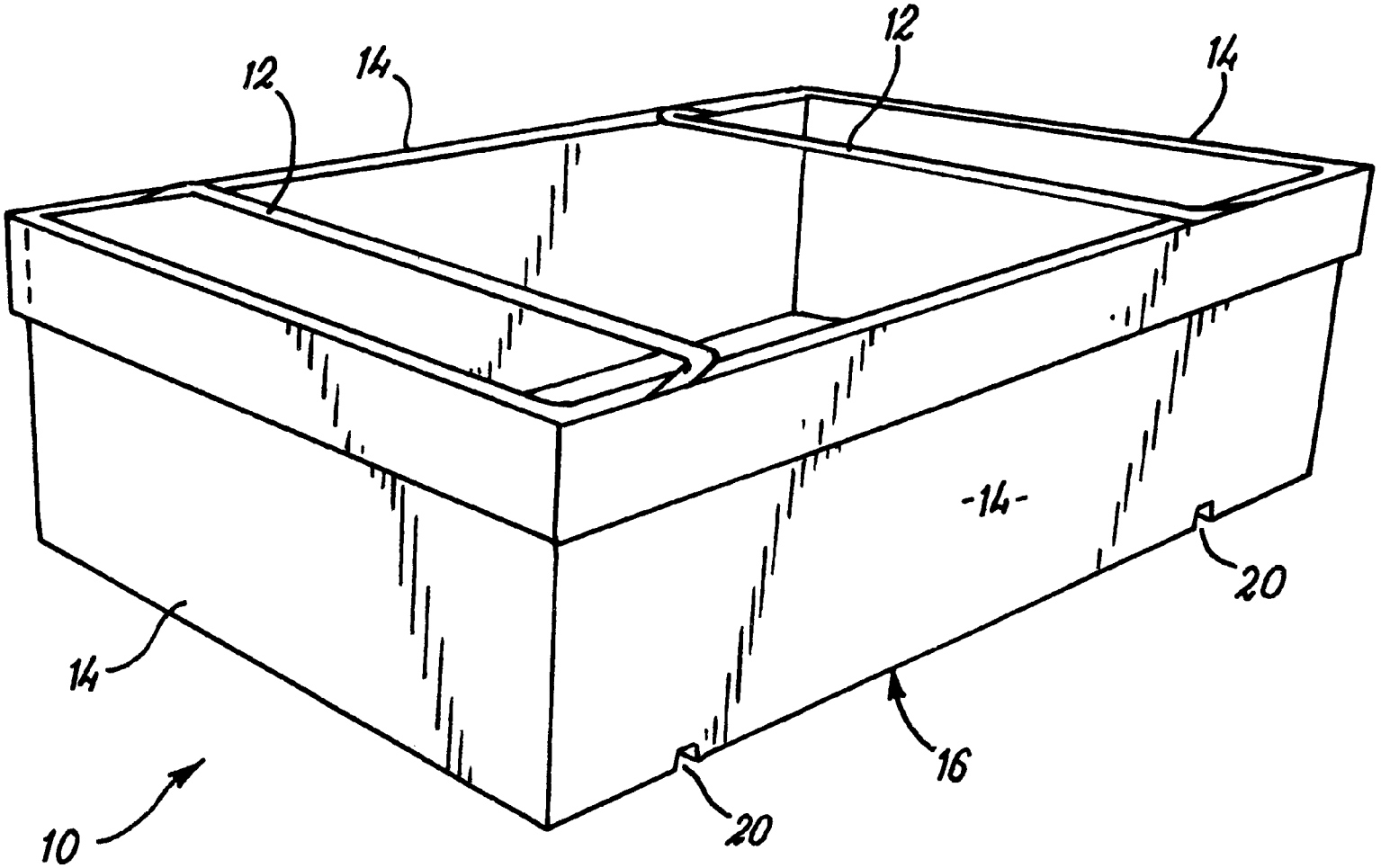
FIG. 1 is a schematic perspective view of a container to which the present invention may be applied.

Turning to the drawings, FIG. 1 shows an open-topped container 10 which has stacking members or bars 12. Each bar 12 has a first position (as shown) extending across the container 10 for supporting a second container to form a stack of containers. The bars 12 are formed to engage a container stacked thereon, as will be described, to prevent lateral movement of the upper container (i.e. movement along the length of the bar 12). The bars 12 are formed to provide engagement over a range of positions along the bars, whereby upper containers of a plurality of different sizes may be held at any other plurality of positions relative to the container below.

Figure 3:
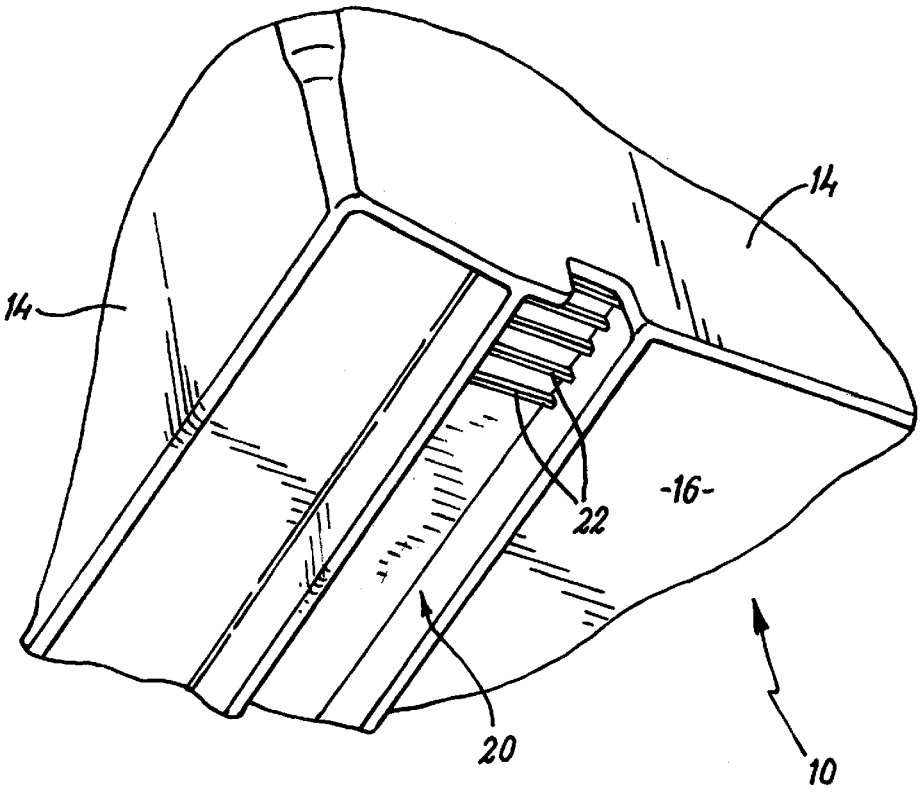
FIG. 3 is a perspective view from beneath of the corner of FIG. 2.

The container 10 is broadly conventional in overall appearance, having four walls 14 upstanding from a base 16 (FIG. 3). Two bars 12 have a stacking position shown in FIG. 1, but can move in conventional manner to a retracted position in which the container mouth is sufficiently clear to allow a like container to be nested therein.

Figure 2:
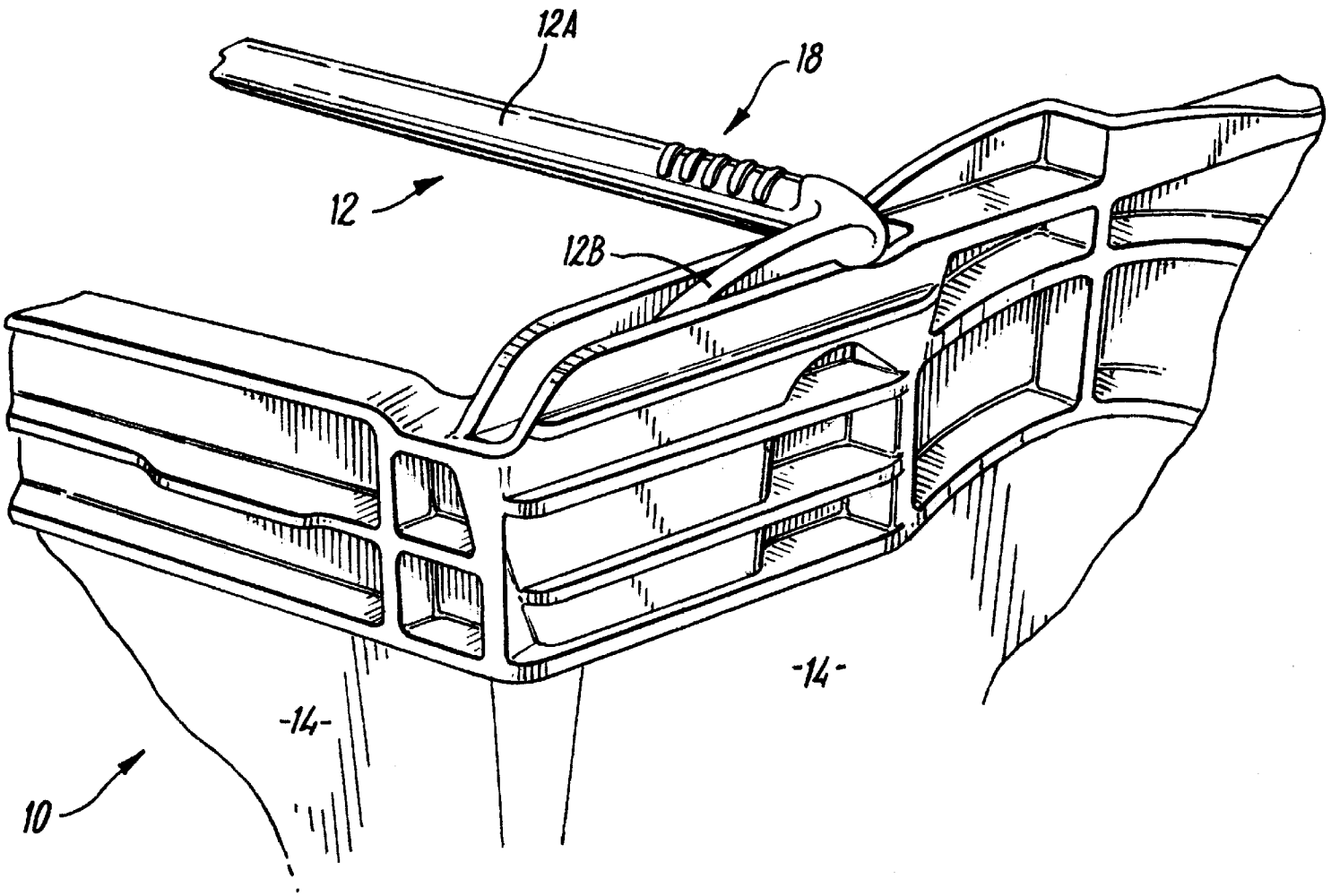
FIG. 2 is an enlarged perspective view of the near corner of the container of FIG. 1, showing features of the invention.

Turning to FIG. 2, each bar 12 has a stacking portion 12A which extends across the container mouth in the position shown, and a connecting portion 12B which connects to a hinge arrangement by which the stacking portion 12A can be moved to the retracted, nesting position.

Near the end of the stacking portion 12A, the bar 12 has a series of equally spaced ribs 18 projecting upwardly when the bar 12 is in the stacking position shown. Each rib 18 has a saw-tooth profile as can be seen more clearly from FIGS. 4 to 6. The ribs 18 each have a steep or vertical face toward the end of the bar 12, and a sloping lead-in surface facing toward the centre of the bar 12.

Figure 4:
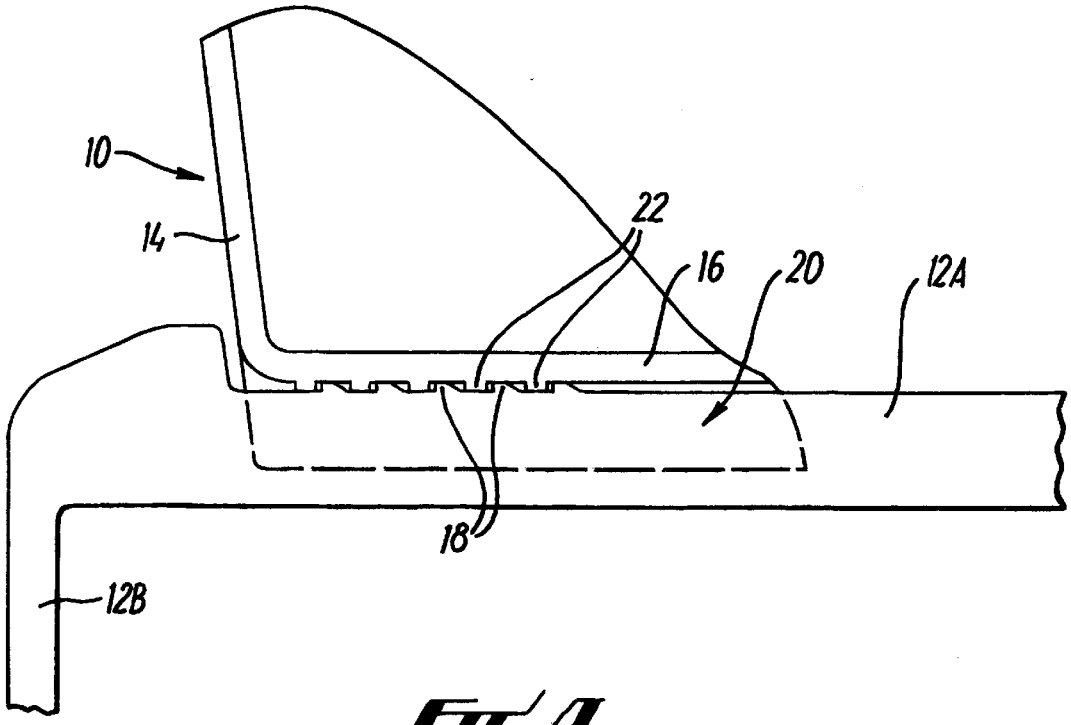

The base of the container (FIG. 3) has a channel 20 for receiving a bar 12 when the container is stacked. The channel walls prevent the upper container moving in a direction perpendicular to the length of the bar 12. A second set of ribs 22 are formed in the base of the channel 20, to project downwardly. These ribs are square or rectangular in section and have a spacing corresponding to the spacing of the ribs 18. In consequence, when the container sits on the bars 12 of a lower container, the ribs 22 can sit between the ribs 18, as shown in FIG. 4. As can be seen from FIG. 4, movement of the upper container toward the centre of the lower container (to the right as shown in FIG. 4) would be prevented by abutment of the ribs 22 against the vertical faces of the ribs 28. Movement of the container in the opposite direction would be prevented by corresponding abutment at the other end of the bar. However, it is desirable for the ribs 22, 18 to be a loose fit with each other to allow some "play" in the engagement. This allows for manufacturing tolerance and also for any distortion which might arise with heavily loaded containers.

Figure 5:
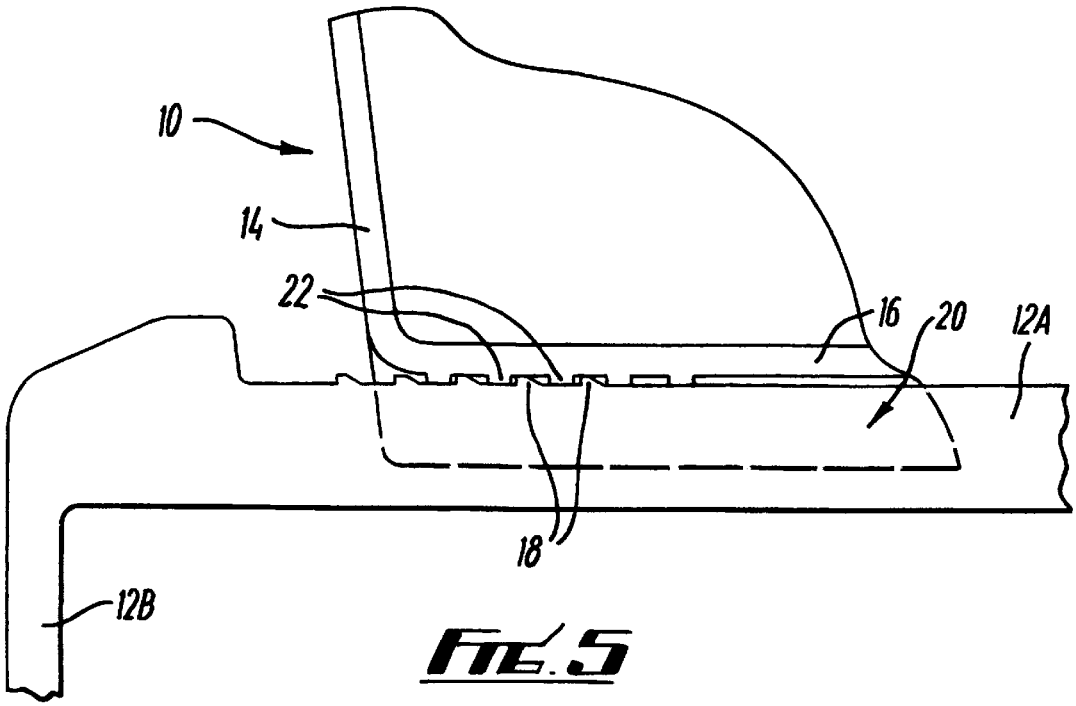

It is also apparent from FIG. 4 that the ribs 18, 22 are complementary formations and can fit together over a range of relative positions of the two containers, because any rib 22 can be received in any of a number of recesses between ribs 18. FIG. 5 shows an alternative alignment and as can be seen, some of the ribs 18, 22 are no longer contributing to the engagement between the upper container and the bar 12. Alignment as shown in FIG. 5 could arise in two distinct ways. Firstly, an upper container could be out of alignment with a lower container (so that a non-vertical stack is being produced). Although this is undesirable generally, it may be acceptable in certain circumstances, but the security of any non-vertical stack is improved by the invention preventing the upper container sliding on the lower container. Secondly, the upper container could be narrower than the lower container but still have ribs 22 formed thereon. Choosing an appropriate number of ribs 18 allows a range of different size containers to stack on each other with the engagement described above. In particular, small containers can stack on large containers and be held in the manner described at any of a range of positions by appropriate engagement of the ribs 18, 22. This is important in that the particular alignment of small containers and large containers may not be critical for other reasons, but maintaining that alignment by engagement of the ribs 18, 22 will enhance the safety of the stack.

Figure 6:
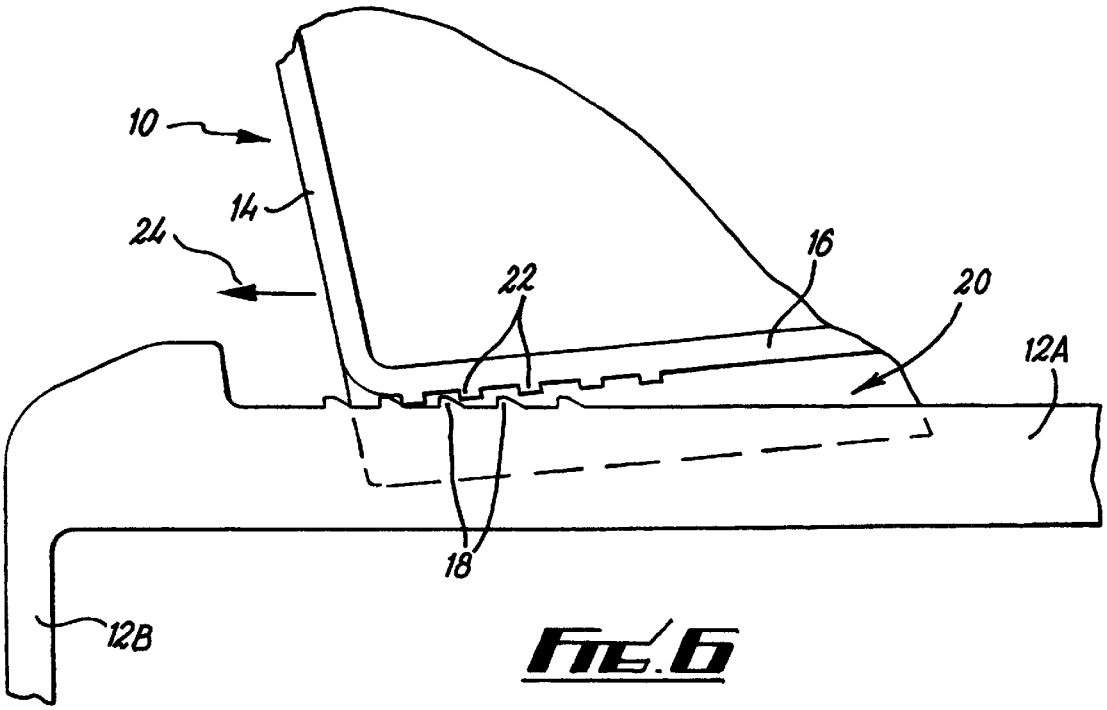
FIGS. 4, 5 and 6 are enlarged schematic sections along the stacking bar of the container showing a second container being stacked.

The purpose of the saw-tooth profile of the ribs 18 can be seen from FIG. 6. When a container is placed on to a stack, it will commonly be raised at one side, so that its base is not flat, placed onto the bars 12 somewhat short of its final position, and then slid along the bars 12 to the final position. The sloping surfaces of the ribs 18 allow the ribs 22 to ride up and over ribs 18 as the upper container is sliding to its final position (in the direction of the arrow 24 in FIG. 6). When the final position is reached, the container will be dropped down on to the bar 12, whereupon the ribs 22 will drop in between the ribs 18 at both ends of the bar, to positions like that shown in FIGS. 4 or 5. The upper container is then held against further sliding, in the manner described above.

It is envisaged that containers of the type described above could be manufactured from a variety of materials, including synthetic plastics material, for instance by injection moulding. Stacking members could take many different forms, such as flaps, bars or other movable members. The engaging formations on the stacking members could take many different forms and the combinations of projections and/or recesses arranged in various patterns, with corresponding patterns of recesses and/or projections being provided in the base of the container. Other complementary formations could be used.

Many variations and modifications can be made to the apparatus described without departing from the scope of the present invention.

I claim:

1. An open-topped container comprising at least one stacking member movable to a first position extending across the container for supporting a second container to form a stack, the stacking member and the container base comprising cooperating formations which engage to prevent lateral movement of the upper container relative to the lower container, the cooperating formations comprising at least one projection or recess formed in the base of the container and at least one cooperating projection or recess formed in the stacking member.

2. A container according to claim 1, wherein the stacking member comprises a plurality of formations for engaging a container above.

3. A container according to claim 1 or 2, wherein at least some of the formations cooperate to resist relative lateral movement in a first sense, but to allow relative lateral movement in the opposite sense.

4. A container according to claim 3, wherein others of the formations resist relative lateral movement in the said opposite sense, but allow relative lateral movement in the first sense.

5. A container according to claim 1, wherein the stacking member comprises a plurality of ribs which define recesses therebetween.

6. A container according to claim 5, wherein at least some of the ribs are regularly spaced.

7. A container according to claim 5 or 6, wherein at least some of the ribs have a saw-tooth profile.

8. A container according to claim 1, wherein the base of the container comprises a plurality of ribs which define recesses therebetween.

9. A container according to claim 1, wherein the base formations comprise a plurality of formations complementary to formations on the stacking member.

10. A container according to claim 1, wherein the cooperating formations are regularly spaced to allow the stacking members to engage a base at a plurality of relative positions.

11. A container according to claim 1, wherein the stacking member is a bar.

12. A container according to claim 11, wherein the bar is movable to a second position at which the container mouth is sufficiently clear to allow a like container to be nested therein.

13. A system comprising a plurality of containers according to claim 1.

14. A system according to claim 13, wherein the containers have a plurality of different sizes and each has engaging formations compatible with smaller-sized containers, wherein each container can be stacked with engagement at any of a plurality of positions on a larger container below.

* * * * *